US008720349B1

(12) United States Patent
David

(10) Patent No.: US 8,720,349 B1
(45) Date of Patent: May 13, 2014

(54) POLE SHELF

(76) Inventor: Edward A. David, Los Angeles, CA (US)

( * ) Notice: Subject to any disclaimer, the term of this patent is extended or adjusted under 35 U.S.C. 154(b) by 527 days.

(21) Appl. No.: 13/049,810

(22) Filed: Mar. 16, 2011

Related U.S. Application Data

(60) Provisional application No. 61/314,602, filed on Mar. 17, 2010, provisional application No. 61/406,706, filed on Oct. 26, 2010.

(51) Int. Cl.
*A47B 37/00* (2006.01)

(52) U.S. Cl.
USPC ..... 108/50.12; 108/185; 108/151; 211/133.4; 211/196

(58) Field of Classification Search
CPC ..... A47B 37/04; A47B 2220/0008; A45B 2200/1063
USPC ..... 211/133.4, 187, 134, 186, 196, 205; 108/50.12, 151, 149, 183, 185; 248/345, 235, 240.2, 250, 405, 410, 248/411, 413; 403/187, 191, 196.199, 403/234–240; 220/23.88, 23.87
See application file for complete search history.

(56) References Cited

U.S. PATENT DOCUMENTS 2,799,543 A * 7/1957 Tomaselli ..... 108/50.12
3,384,260 A * 5/1968 Buffington ..... 206/558
3,620,174 A 11/1971 Dentino
3,628,844 A * 12/1971 Preston ..... 312/305
4,534,474 A * 8/1985 Ng ..... 211/70
4,587,908 A * 5/1986 DeBruyn ..... 108/142
4,627,543 A * 12/1986 Nicely ..... 211/187
4,708,256 A 11/1987 Intardonato
D325,281 S * 4/1992 Jordan ..... D3/302
5,161,561 A * 11/1992 Jamieson ..... 135/16
5,335,803 A 8/1994 O'Brien et al.
5,493,976 A 2/1996 Hammond
5,848,712 A 12/1998 Weir
5,894,944 A * 4/1999 Swift ..... 211/78
5,934,634 A * 8/1999 Lindblom ..... 248/230.1
5,996,511 A 12/1999 Swoger
6,123,206 A * 9/2000 Zaremba ..... 211/107
6,161,333 A 12/2000 Poston
6,463,946 B1 * 10/2002 Wu ..... 135/16
6,477,966 B1 * 11/2002 Petryna ..... 108/11
6,637,717 B2 * 10/2003 Li ..... 248/519

(Continued)

*Primary Examiner* — Darnell Jayne
*Assistant Examiner* — Hiwot Tefera
(74) *Attorney, Agent, or Firm* — Roy L. Anderson; Wagner, Anderson & Bright PC

(57) ABSTRACT

A pole shelf for mounting to a pole has a two-piece bracket and a two-piece shelf. The bracket is removably secured to poles of different diameters by adjusting a sliding engagement existing between pairs of male and female mating sleeves. The bracket pieces have a lip between upper and lower hub protrusion ribs and the lip has an outer cam edge with detents. The shelf pieces have a protrusion rib, an outer wall and a shelf bottom between the protrusion rib and outer wall, a retention post on the underneath side of the shelf bottom, a connector for releasably connecting ends of the two shelf pieces to each other and one or more shelf bottom connectors for releasably connecting the shelf bottoms to each other. When the shelf is in a closed state it is secured to the bracket, which itself is secured to a pole, by engaging the retention posts of shelf pieces with the outer cam edges of the bracket pieces and rotating the shelf so that the outer cam edges become removably locked into the retention posts.

10 Claims, 16 Drawing Sheets

(56) References Cited

U.S. PATENT DOCUMENTS

| | | | | |
|---|---|---|---|---|
| 6,688,239 | B1 * | 2/2004 | Pettini et al. | 108/50.11 |
| 6,837,386 | B1 * | 1/2005 | Kent et al. | 211/153 |
| 7,155,860 | B1 * | 1/2007 | Ferguson, III | 47/66.6 |
| 7,213,951 | B2 | 5/2007 | Cowan | |
| 8,640,894 | B1 * | 2/2014 | Cronin | 211/205 |
| 2001/0040208 | A1 * | 11/2001 | Li | 248/519 |
| 2002/0185582 | A1 * | 12/2002 | Li | 248/522 |
| 2005/0072711 | A1 * | 4/2005 | Yang | 206/545 |
| 2005/0109247 | A1 | 5/2005 | Nelson et al. | |
| 2005/0183638 | A1 * | 8/2005 | Lin | 108/51.11 |
| 2008/0292394 | A1 * | 11/2008 | Yang | 403/344 |
| 2009/0120477 | A1 * | 5/2009 | Li | 135/16 |

* cited by examiner

POLE SHELF

CROSS-REFERENCE TO RELATED APPLICATIONS

The present invention claims priority from U.S. Patent Application No. 61/314,602, filed Mar. 17, 2010, and U.S. Patent Application No. 61/406,706, filed Oct. 20, 2010, both of the same title, the disclosures of both of which are specifically incorporated herein by reference.

FIELD OF THE INVENTION

The present invention relates generally to shelves and more specifically to a pole shelf, which is attached to a pole of an umbrella or the like.

BACKGROUND OF THE INVENTION

Umbrella tables are a popular feature of pools, restaurants and porches, especially where the weather is nice. Such tables typically have an umbrella which is held by a ground weight and a separate table with a center hole in which the umbrella can be placed. Umbrella tables can be quite large, and suitable for seating many people for dinner, the umbrella providing a nice shade for the table.

While the charm of umbrella tables is well known, it is often desirable to have an umbrella by itself, without a table, such as what one might use at a beach. Even where umbrella tables are used, it may still be desirable to have additional trays that are separate from the table itself, and it is known that trays can be supported by the table.

It is also known that shelves and the like can be mounted to umbrellas or other poles that are not supported by a separate table. However, such shelves typically are rather flimsy, meaning they cannot hold much weight, or they are either permanent or not readily removable from the pole, or even cannot be easily separated from a pole.

The present invention seeks to provide a versatile, strong, easily attachable and detachable pole shelf that can be attached to poles of different sizes, and even to square poles, while offering advantages not provided by previous pole shelves.

SUMMARY OF THE INVENTION

The present invention is generally directed to a pole shelf for mounting on a pole having two parts, a bracket and a shelf, that are capable of being secured about and removed from the pole. The bracket has a surface that contacts the pole, a releasable fastener for locking it in a closed position secured to the pole and a first shelf retention lock piece while the shelf has a shelf surface that contacts the bracket, a shelf bottom extending from the shelf surface and a second shelf retention lock piece. The bracket can be removably secured to poles with different diameters by adjusting the releasable fastener and the shelf is secured to the pole by engaging the first and the second shelf retention locks with each other.

In a first, separate group of aspects of the present invention, a pole shelf for mounting to a pole has a two-piece bracket and a two-piece shelf. The bracket can be removably secured to poles of different diameters by adjusting a sliding engagement existing between pairs of male and female mating sleeves. The bracket pieces have a lip between upper and lower hub protrusion ribs and the lip has an outer cam edge with detents. The shelf pieces have a protrusion rib, an outer wall and a shelf bottom between the protrusion rib and outer wall, a retention post on the underneath side of the shelf bottom, a connector for releasably connecting ends of the two shelf pieces to each other and one or more shelf bottom connectors for releasably connecting the shelf bottoms to each other. When the shelf is in a closed state it is secured to the bracket, which itself is secured to a pole, by engaging the retention posts of shelf pieces with the outer cam edges of the bracket pieces and rotating the shelf so that the outer cam edges become removably locked into the retention posts.

In a second, separate group of aspects of the present invention, the shelf has a second connector (such as a pin hinge) for releasably connecting second ends of the shelf pieces to each other, the shelf bottom has drain holes, inserts (such as containers, trays and cup holders) can be inserted into and held in place in the shelf by a tab in the drain holes, the shelf outer wall can have a double wall construction and securing the shelf to the bracket can further secure a connector of the shelf and the inner walls of the bracket pieces can have notches for holding square poles.

Accordingly, it is a primary object of the present invention to provide an improved pole shelf.

This and further objects and advantages will be apparent to those skilled in the art in connection with the drawings and the detailed description of the invention set forth below.

BRIEF DESCRIPTION OF THE DRAWINGS

FIG. 2 is a top plan view of a shelf in use with a partial cutaway of a pole in a preferred embodiment of the present invention in a closed position while

FIG. 3 is a bottom plan view of a shelf for use in a preferred embodiment of the present invention in a closed position when it is not around a pole while

FIG. 4 illustrates a top view, FIG. 5 illustrates a bottom view, and FIG. 5A illustrates an exploded view of FIG. 5.

FIG. 6 illustrates a preferred embodiment of the present invention in which the bracket has been mounted to a pole and the shelf is in a closed state about the pole before it is locked with the bracket while

FIGS. 8-10 illustrate top plan views of the container insert, shelf insert and cup holder insert of FIG. 7 while

DETAILED DESCRIPTION OF THE INVENTION

The present invention is generally directed to a pole shelf having a removable bracket that can be securely, but removably, mounted to a pole, and a shelf that can be closed about a pole and then securely and removably locked to the bracket. This two piece construction allows the bracket to be left on a pole when the shelf is removed. It also enables the pole shelf to be very sturdy, and capable of holding considerable weight, while still being quite versatile. In addition, removable inserts, such as containers, tray and cup holders, allow the pole shelf to be customized for individual use, and for its configuration to be easily varied.

The bracket of the present invention must generally have a bracket surface for contacting the pole, a releasable fastener for locking the bracket in a closed position in which it is secured to the pole, and a first shelf retention lock piece while the shelf of the present invention must generally have a shelf surface for contacting the bracket, a shelf bottom extending outwardly from the shelf surface and a second shelf retention lock piece so that the shelf can be secured to the pole by engaging the first and the second shelf retention lock pieces with each other. The structure that locks the bracket and shelf together should be easy and quick to use, yet provide a very sturdy connection that allows the shelf to benefit from the strength of the bracket connection to the pole. It is especially desired that the bracket surface has two or more notches so that the bracket can be secured to a pole having an angular edge, such as a square pole. Both the bracket and the shelf can have a two piece construction, or either of them can have two pieces that are integral to each other yet open to allow them to be fitted to a pole.

The present invention will now be described by reference to an especially preferred embodiment which is the best mode of the invention contemplated by the inventor at the present time. While the following description will describe this best mode, the invention is not meant to be limited to the construction of the best mode.

In the Figures and the following more detailed description, numerals indicate various features of the best mode of the invention, with like numerals referring to like features throughout both the drawings and the description.

Although the Figures are described in greater detail below, the following is a glossary of the elements identified in the Figures.

Figure 1:
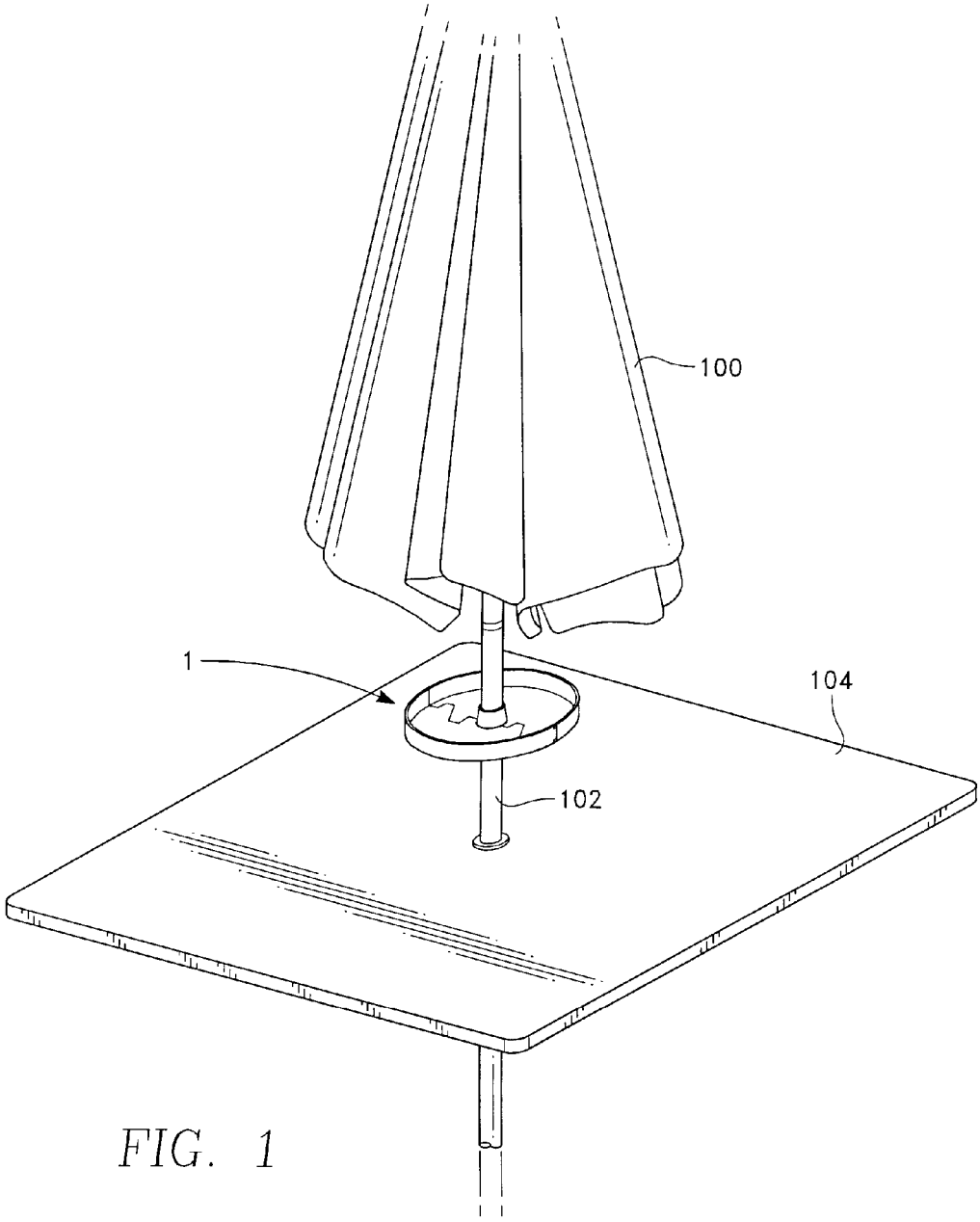
FIG. 1 illustrates a preferred embodiment of the present invention in use around a pole.

1 pole shelf
10 shelf
11 first shelf piece
12 second shelf piece
13 upper surface of shelf bottom
14 hub protrusion
15 outer inner wall
16 outer wall top surface
17 peripheral outer wall
18 male pin hinge
19 female pin hinge
20 latch protrusion
21 window for receiving latch protrusion 20
22 security fastener
23 drain slot
24 bottom protruding section
25 bottom recessed section for receiving bottom protruding section 24
26 holding tab formed in bottom recessed section 25
26*a* slanted tab of holding tab 26
26*b* recess of holding tab 26
27 holding ribs formed on underside of bottom protruding section 24 for being held in recess 26*b*
28 rib
29 hub rib
30 retention post
31 lip in retention post 30
32 cutaway in retention post 30 that forms lip 31
40 insert tab
41 insert radius
42 insert wall
43 insert outer radius wall
44 insert outer lip for contact with outer wall top surface
45 container insert
46 container insert space
47 shelf insert
48 upper shelf insert surface
49 cup holder insert
50 space for cup in cup holder insert 49
60 bracket
61 first bracket piece
62 second bracket piece
63 lip
64 upper hub protrusion rib
64IW inner wall of upper hub protrusion rib 64
65 bottom hub protrusion rib
65IW inner wall of bottom hub protrusion rib 65
66 male mating sleeve
67 female mating sleeve
68 fastener
68*s* screw
68*n* nut
69 outer cam edge of lip 63
70 detent in outer cam edge 69
71 notch of inner wall of hub protrusion ribs
100 pole umbrella
102 pole
104 table As illustrated in the Figures, the present invention is generally directed to a pole shelf, generally designated as 1 (see FIG. 1), that can be fitted to a pole. The pole can be part of a standard umbrella table or any other type of pole, such as, for example, a four-legged collapsible tent with telescoping poles. The pole can have a circular shape, or a square shape, or even another shape.

Pole shelf 1 can be secured to, or removed from, a pole without the necessity of sliding it off of the pole, and yet be self-supporting and secure when it is in place and secured to the pole and capable of holding heavy items such as containers of liquids. In other words, it is easily added or removed, yet it has a structural stability suggesting a more permanent means of attachment, such as brackets that are not really readily or easily removable from the pole.

Figure 6:
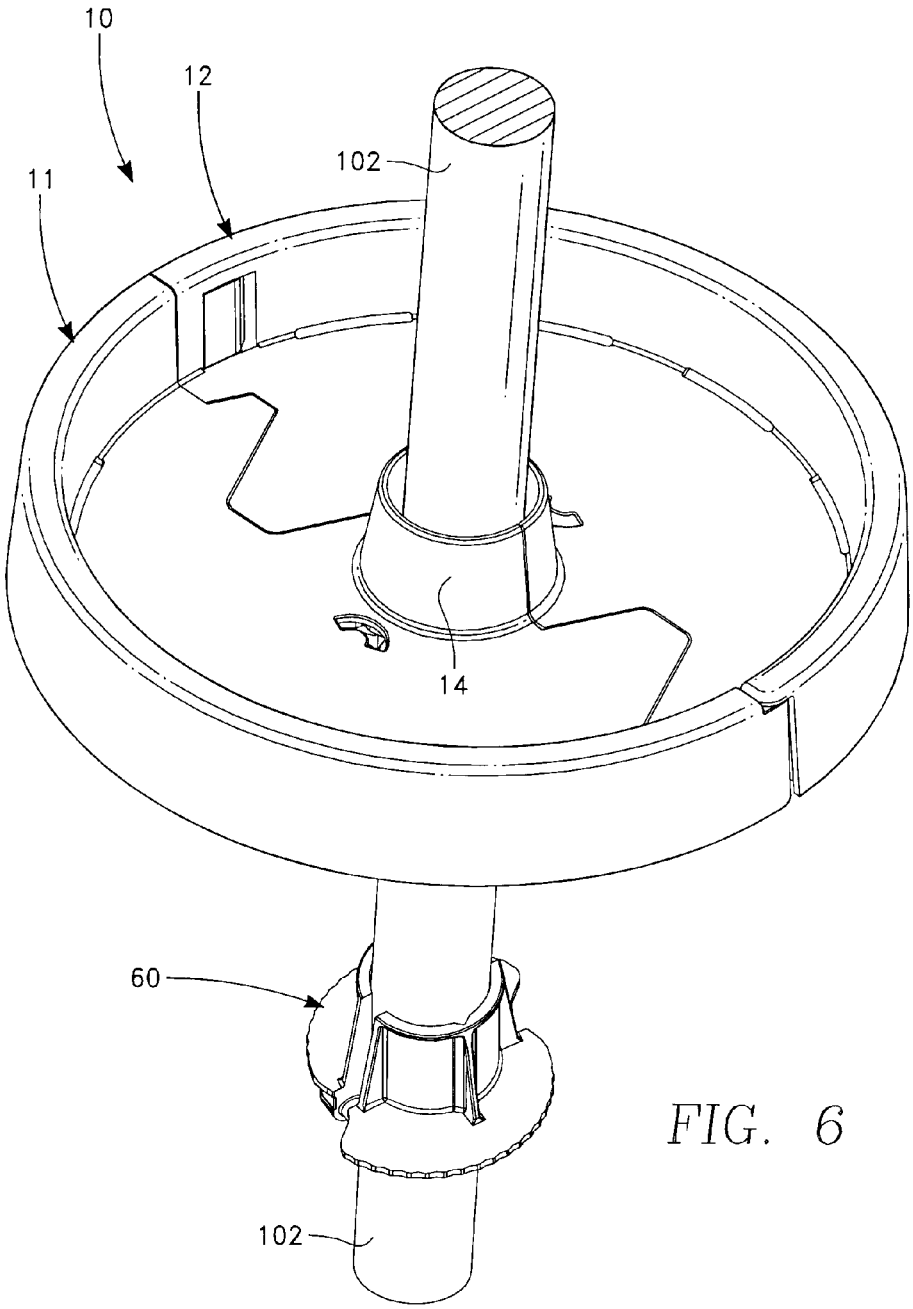
Figure 6A:
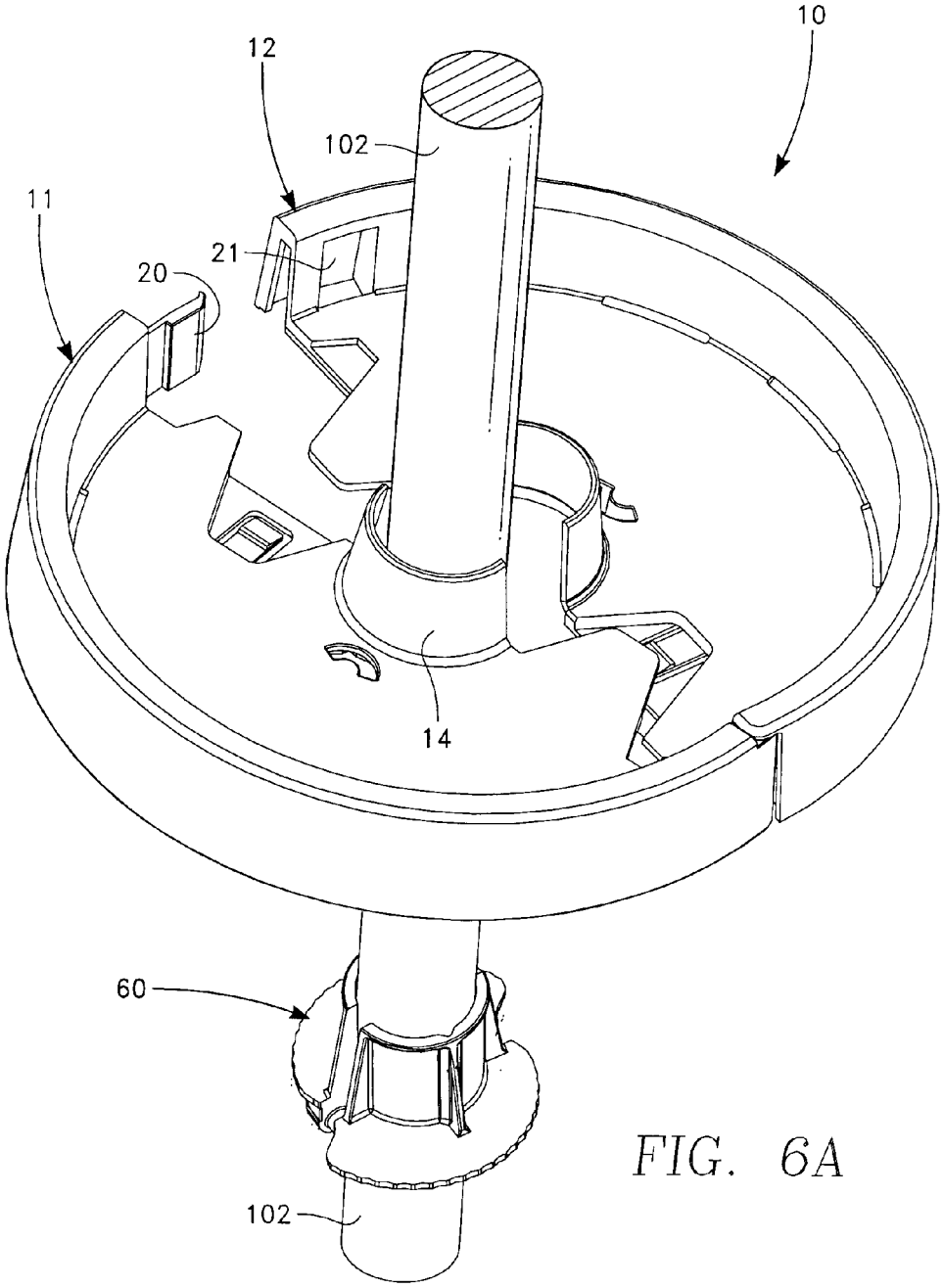
FIG. 6A illustrates shelf of FIG. 6 in an open state at one end just as it is about to be closed.

Pole shelf 1 is broadly comprised of two parts. First, it has a bracket 60 which is initially secured to a pole 102. Once bracket 60 has been so secured, then shelf 10 is itself removably secured to bracket 60 (see FIGS. 6 and 6A). When one wants to remove pole shelf from pole 102, the attachment process can be reversed, by first removing shelf 10 from bracket 60, then detaching bracket 60 from pole 102. However, an advantage of the present invention is that bracket 60 can remain in place on pole 102, with shelf 10 removed, if pole shelf 1 will again be used on pole 102, but it is desirable to remove shelf 10. Thus, for example, an umbrella pole might be collapsed for the night and brought in from an outdoor location. In this scenario, once shelf 10 has been removed, the umbrella can be collapsed, leaving bracket 60 in place for use the next day, while still allowing the umbrella to be collapsed. Thus, the two part removability of shelf 10 and 60 bracket aids in ease of use and quick assembly.

Figure 4:
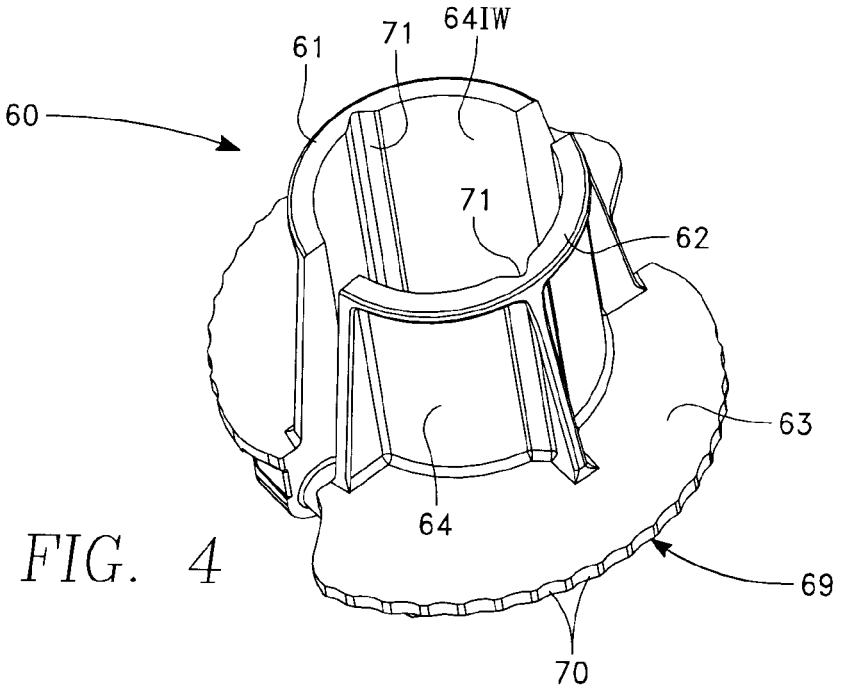
FIGS. 4, 5 and 5A illustrate a bracket for use in a preferred embodiment of the present invention.
Figure 5:
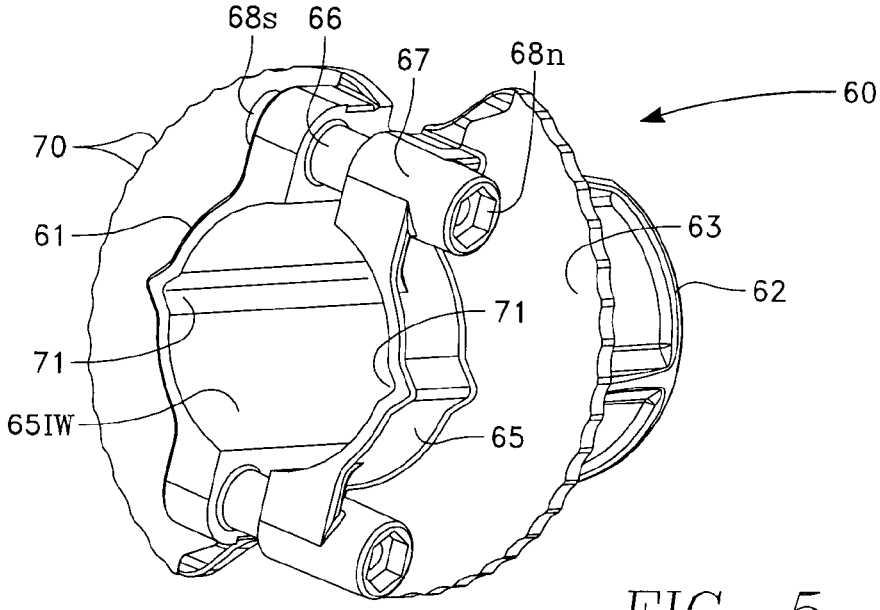
Figure 5A:
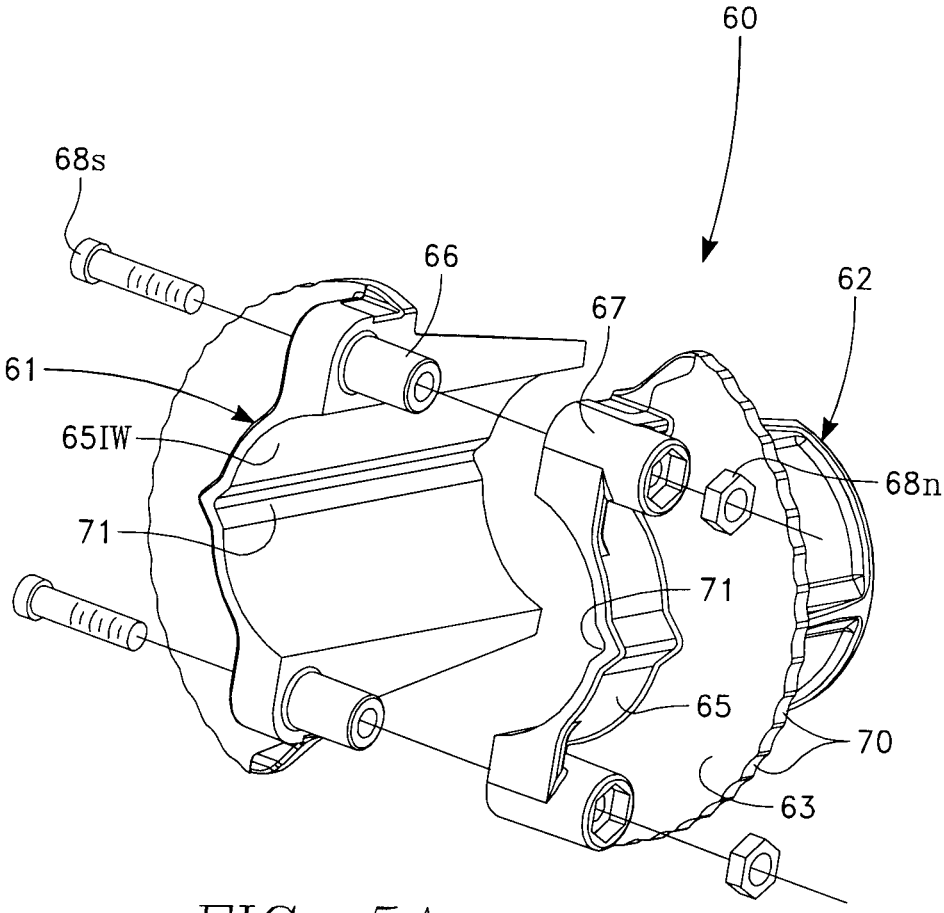
Figure 12:
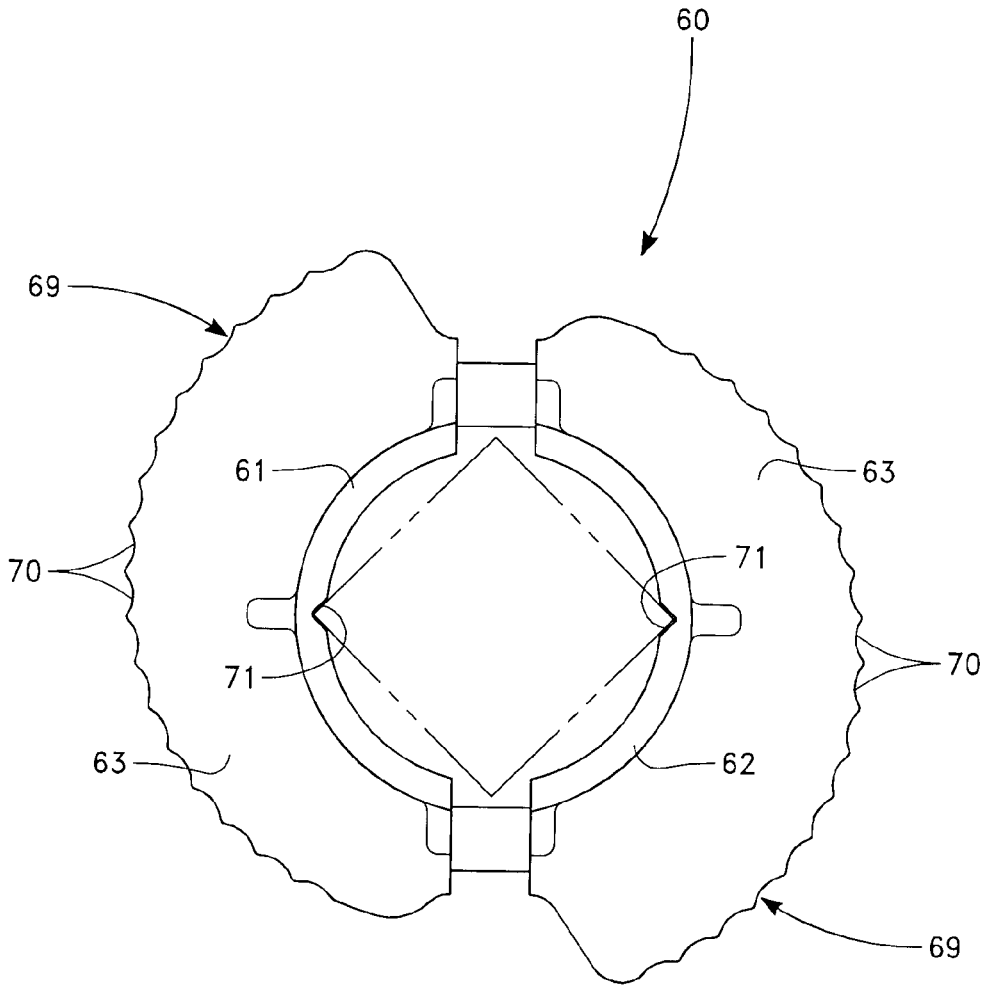
FIG. 12 is a bottom plan cutaway view showing the bracket of the present invention as it is secured to a square pole.

Bracket 60, in an especially preferred embodiment, is capable of fitting various sizes of poles, and various shapes of poles. Bracket 60 is generally comprised of first and second bracket pieces 61 and 62, see FIGS. 4, 5 and 5A, each of which has an upper hub protrusion rib 64 extending above a lip 63 and bottom hub protrusion rib 65 extending below lip 63. Upper hub protrusion rib 64 and bottom hub protrusion rib 65 have inner walls 64IW and 65IW which are generally radiused so that they will receive circular poles, although they can also have aligned notches 71 to hold corners of square or rectangular poles as shown in FIGS. 4, 5 and 12. Lip 63 extends out perpendicularly from upper hub protrusions rib 64 and bottom hub protrusion rib 65 and has an outer cam edge 69 with detents 70 for engaging retentions posts 30 of first and second shelf pieces 11 and 12, discussed later.

First and second bracket pieces 61 and 62 can be completely separated, which allows them to be placed around, or removed from, pole 102. Bracket pieces 61 and 62 are held together in place around pole 102 by two fasteners (one example of which is screw 68*s* and nut 68*n*) that are tightened to force two male mating sleeves 66 into two female mating sleeves 67 so as to cause inner walls 64IW and 65IW of hub protrusion ribs 64 and 65 to engage pole 102 and thus secure bracket 60 to pole 102. It is especially preferred that each of the two male mating sleeves 66 and each of the two female mating sleeves 67 be placed on either the first or the second bracket piece, but one of each could be placed on either bracket piece.

Bracket 60 is designed to very tightly secure it, in a closed position, to a pole. This security adds strength to pole tray 1, when it is fully assembled. Once bracket 60 is tightly secured to a pole, it is ready to receive a shelf which can then be quickly and conveniently secured to the bracket to end up with a very secure pole tray, thanks to the secure connection of the bracket to the pole and then also of the shelf to the bracket.

Shelf 10 has two pieces, 11 and 12, that can, in an especially preferred embodiment, be completely separated and each of which is roughly half the size of shelf 10, although this preferred sizing is not a requirement of the present invention. Each of the two shelf pieces 11 and 12 has an upper surface 13 which serves as the shelf bottom, a hub protrusion 14 extending up from upper surface 13 toward pole 102, an outer inner wall 15, an outer wall top surface 16, a peripheral outer wall 17 and drain slots 23.

Outer wall 15, outer wall top surface 16 and peripheral outer wall 17 combine to create a double walled outer wall structure. Drain slots 23, in an especially preferred embodiment, are placed every thirty degrees except for where first and second shelf pieces 11 and 12 are joined together, which provides ten such drain slots. The drain slots allow water to drain from shelf 10 and also can serve as registration holes for an insert tab 40, discussed later.

Hub protrusion 14 is, in an especially preferred embodiment, of the same height as upper hub protrusion rib 64 so as to create an aesthetically pleasing appearance in which both hubs combine together to give the appearance of a uniform and rigid structure.

Figure 2:
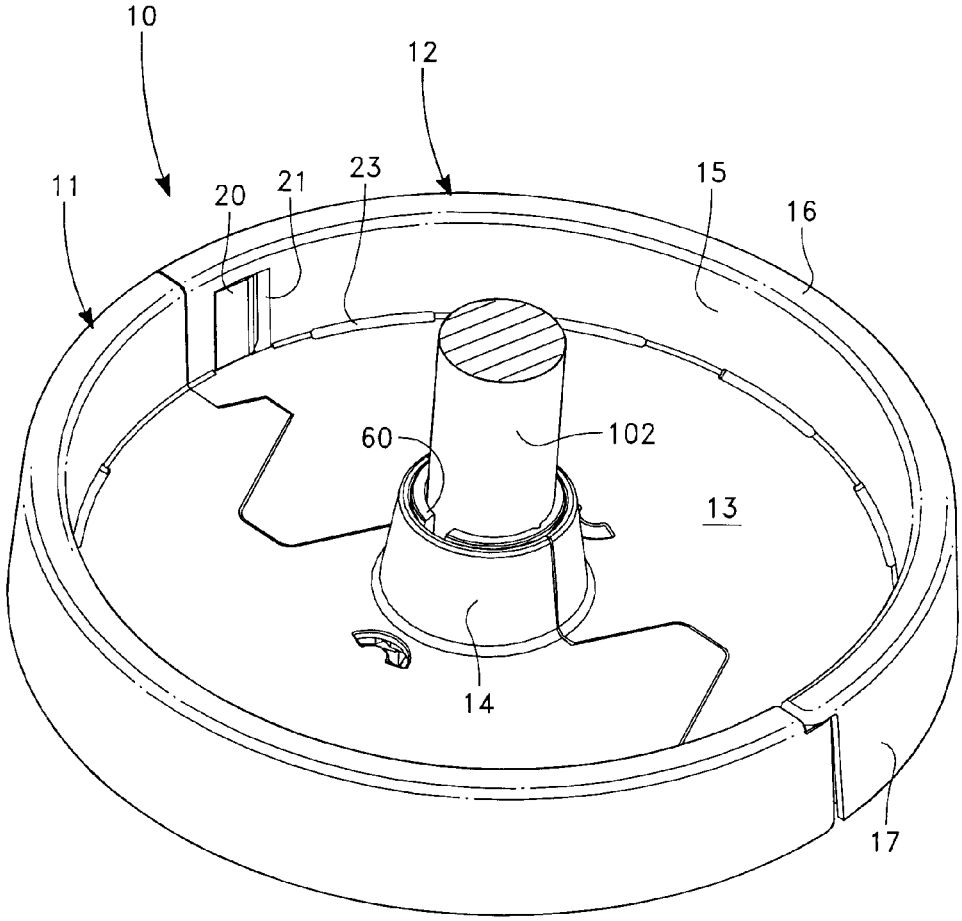
Figure 2A:
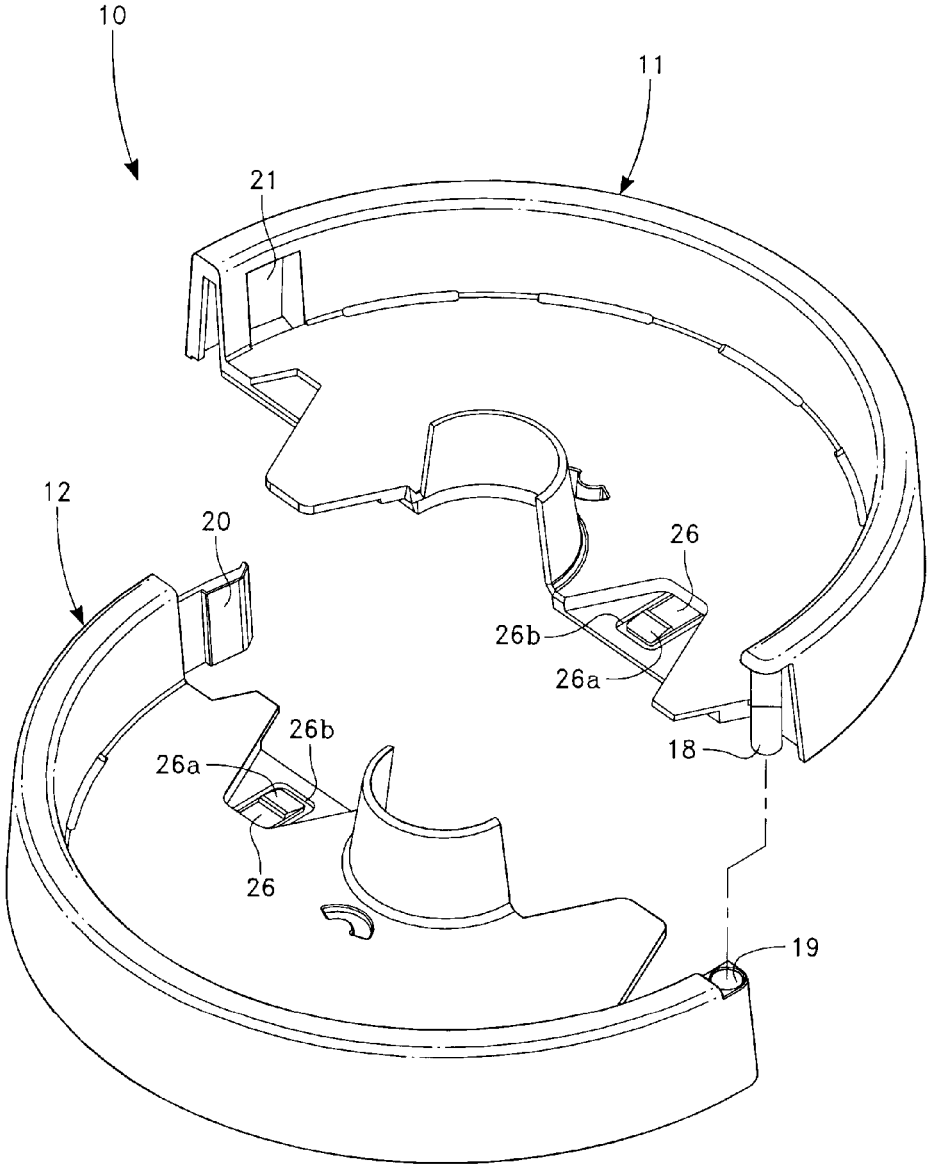
FIG. 2A illustrates the shelf with its two pieces unconnected.
Figure 11:
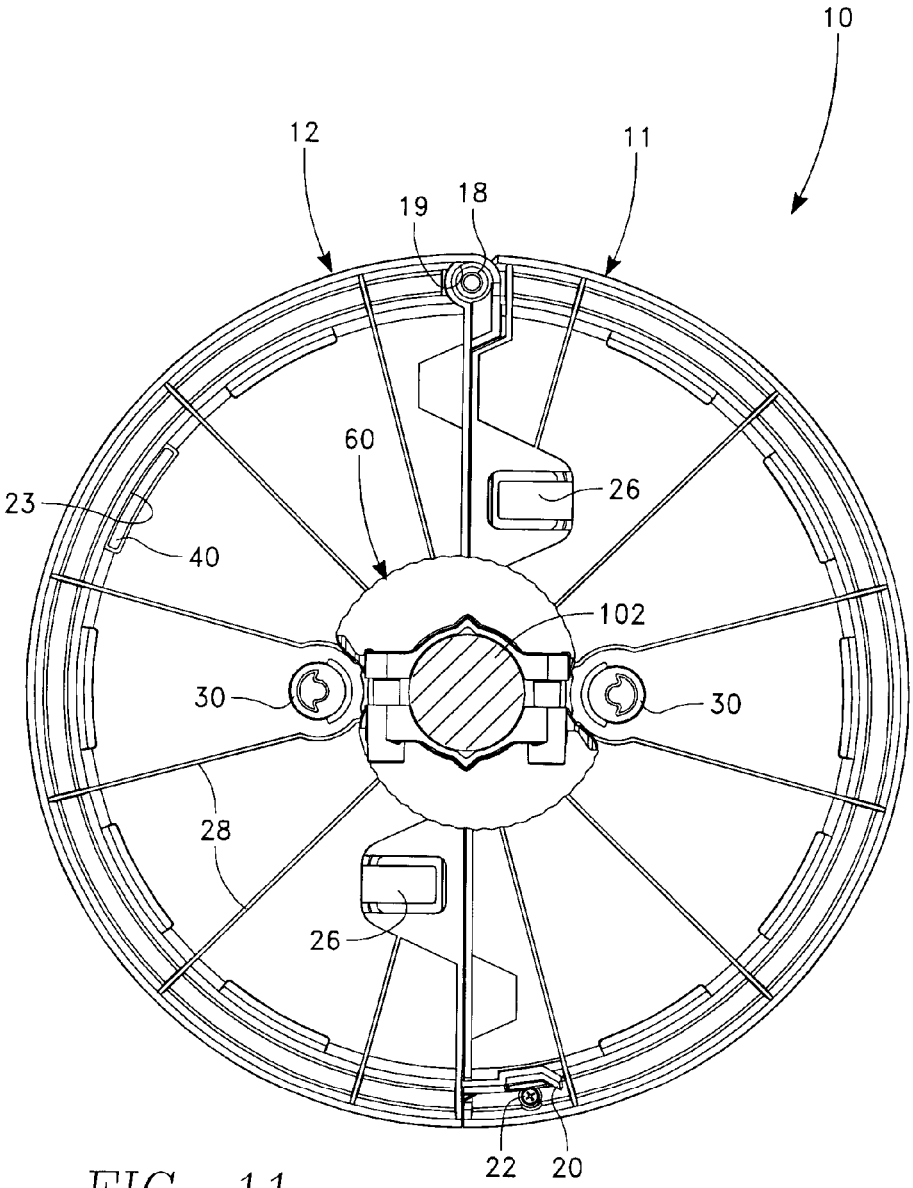
FIG. 11 illustrates a bottom plan view of the present invention when it is secured about a pole and a security fastener has been used to secure the shelf in a closed state but the shelf and the bracket have not yet been locked together.

In an especially preferred embodiment, shelf pieces 11 and 12 are held together at a first end by male and female pin hinges 18 and 19 (see FIGS. 2 and 2*a*) and at a second end by a latch mechanism such as what is shown in FIGS. 2 and 2*a* where latch protrusion 20 snaps into window 21 in a closed position. Latch protrusion 20, as shelf 10 is being closed, fits in between the double walls and as pieces 11 and 12 are closed together, it snaps into window 21. To release pieces 11 and 12, snap protrusion 20 is pushed back into window 21 and the two pieces are pulled apart. To prevent such removal, an optional security fastener 22 (see FIG. 11) can be used to prevent latch protrusion from being retracted from window 21 until security fastener 22 is removed.

Each of shelf pieces 11 and 12, in an especially preferred embodiment, has opposite and opposing quick release connectors on overlapping tabs to serve as locking mechanisms to keep upper surface of shelf bottom 13 sturdy and flat. As shown in FIGS. 2 and 2*a*, each shelf piece has a bottom protruding section 24 that fits into a bottom recessed section 25 opposite it in the other shelf piece that receives it when the two pieces are assembled together in a closed position. Bottom recessed section 25 has a holding tab 26 which includes a slanted tab 26*a* and a recess 26 designed to hold holding ribs 27 formed on the underside of bottom protruding section 24.

Figure 3:
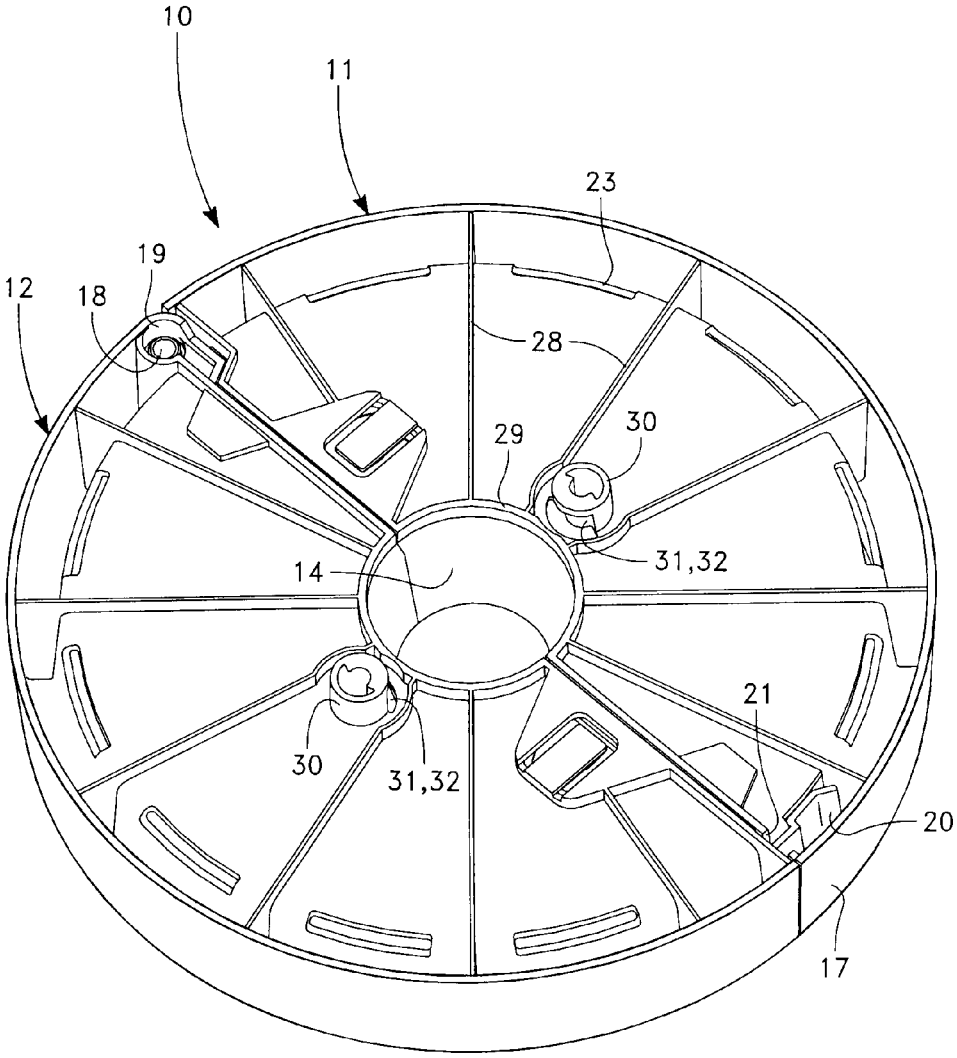
Figure 3A:
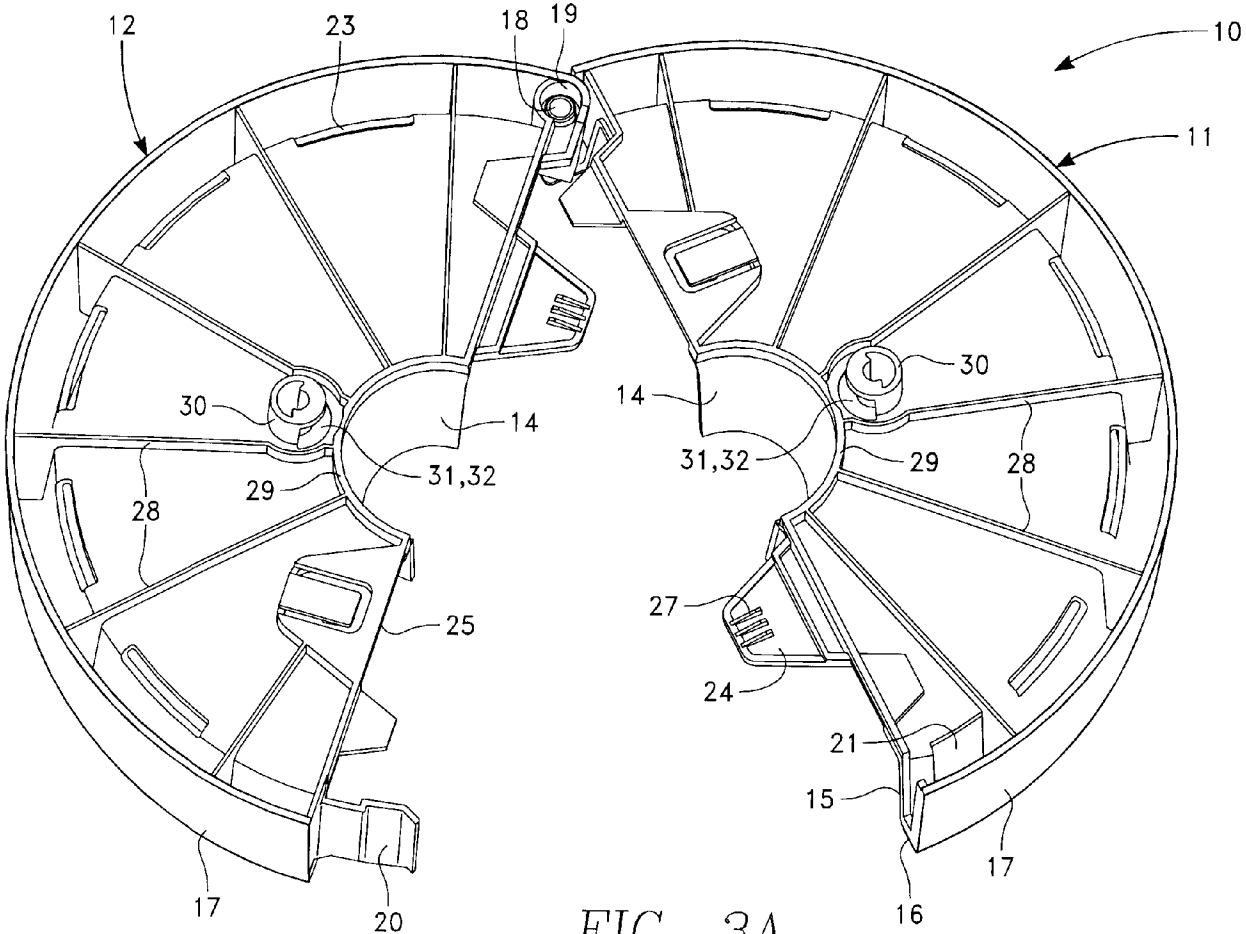
FIG. 3A illustrates the shelf with its two pieces opened at a latch but connected by a pin hinge.
Figure 11A:
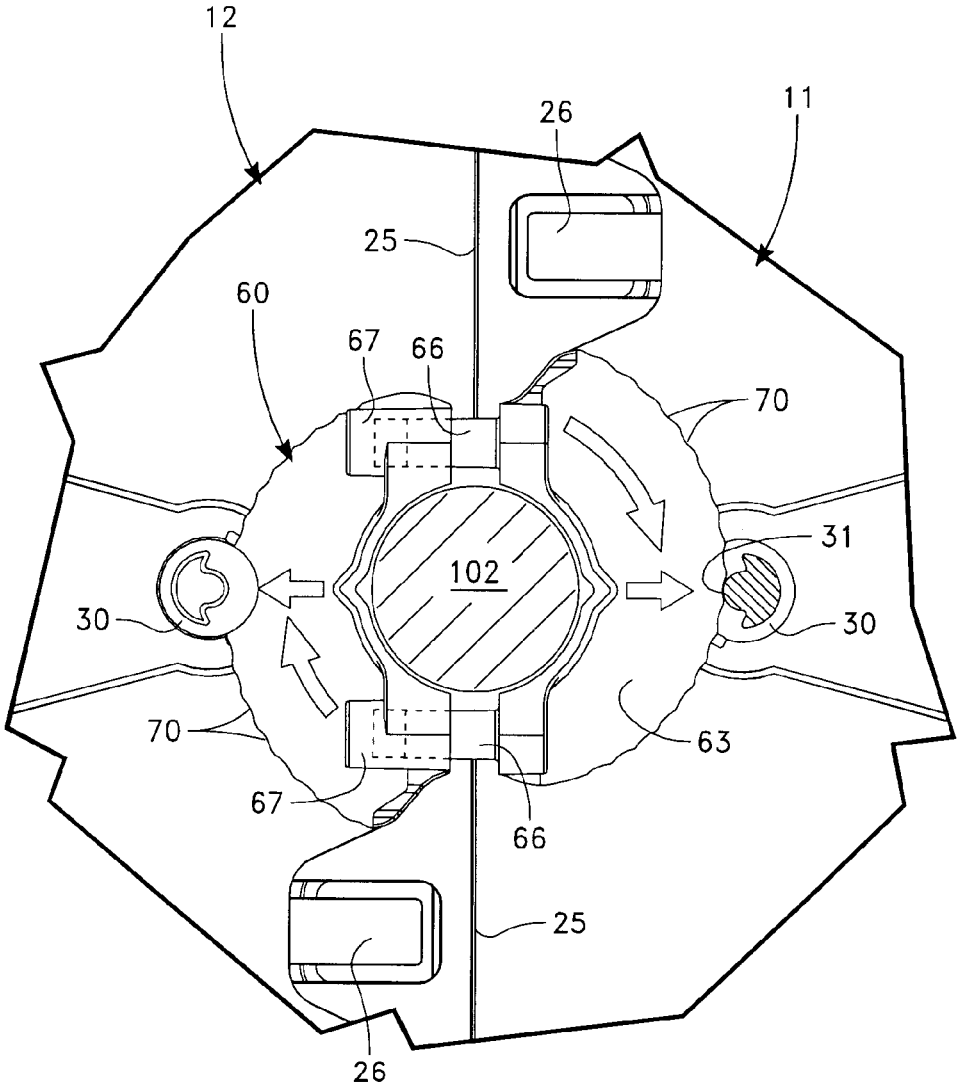
FIG. 11A illustrates how the shelf is secured to the bracket and also shows, on its right side, a partial cutaway of a detent in an outer cam edge of a bracket lip as it is engaged and locked with a retention post.

Each of shelf pieces 11 and 12, on its underside, has structural ribs 28 and a hub rib 29 (see FIG. 3), along with a retention post 30 that has a lip 31 and a cutaway 32 that forms lip 31. Once bracket 60 has been secured to pole 102, and the two pieces of shelf 10 have been snapped together to form a closed position above bracket 60 on pole 102, shelf 10 is lowered onto bracket 60 and rotated so that outer cam edges 69 of lip 63 of bracket 60 engage retention post 30 and detents 70 become secured by retention post 30 inside cutaway 31 while lip 63 rests on lip 31 in a removably locked position in which the camming action (depicted by the larger curved directional arrows in FIG. 11A) causes force toward retention posts 30 as shown by the shorter arrows in FIG. 11A. In the best mode of the invention, this force also serves to strengthen the locking action of latch protrusion 20 in window 21 because it puts additional force in a locking position and makes it harder to unlatch latch protrusion 20 from window 21. To remove shelf 10 from bracket 60, shelf 10 must be rotated in the opposite direction from when it was secured to bracket 60 so as to disengage outer cam edges 63 from retention posts 30. Once shelf 10 and bracket 60 are disengaged and no longer secured to each other, shelf 10 can be quickly and easily opened by pushing latch protrusion 20 into window 21 and then opening that end of tray 10 (see FIG. 6A).

So far preferred embodiments of the present invention have described a very secure, yet easily removable, pole shelf 1 for use with a pole umbrella 100 or a pole 102. The shelf, once it is secured in place about pole 102, can perform any number of functions and hold any number of items. However, for purposes of versatility, it is especially preferred that additional inserts can be securely fitted into shelf 10 to customize use of pole shelf for the given occasion or need for which it is intended. This can be done by using any number of inserts that may perform various functions, and three examples of such function, which are not meant to be limiting but rather illustrative, will now be discussed.

Figure 7:
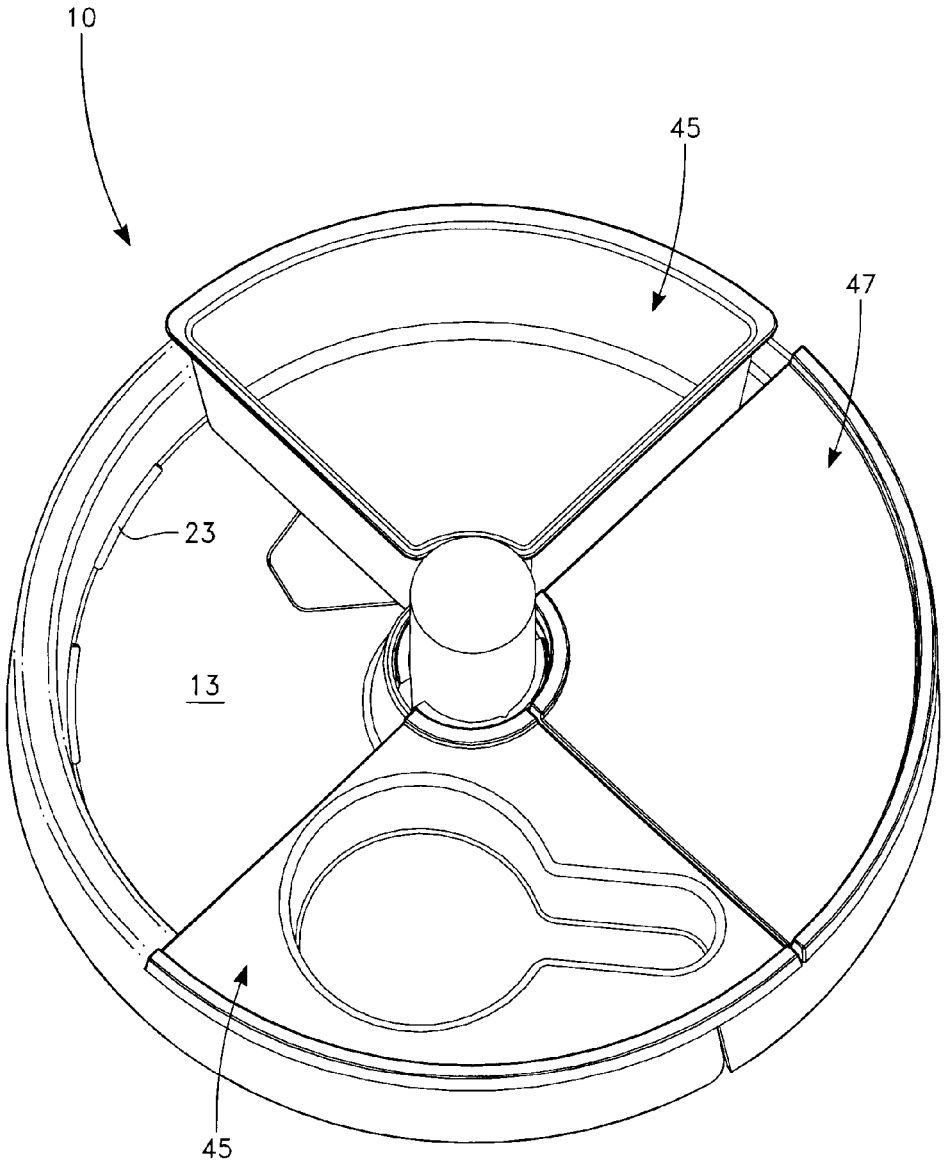
FIG. 7 illustrates a preferred embodiment of the present invention having three different inserts—a container, a shelf and a cup holder.
Figure 8:
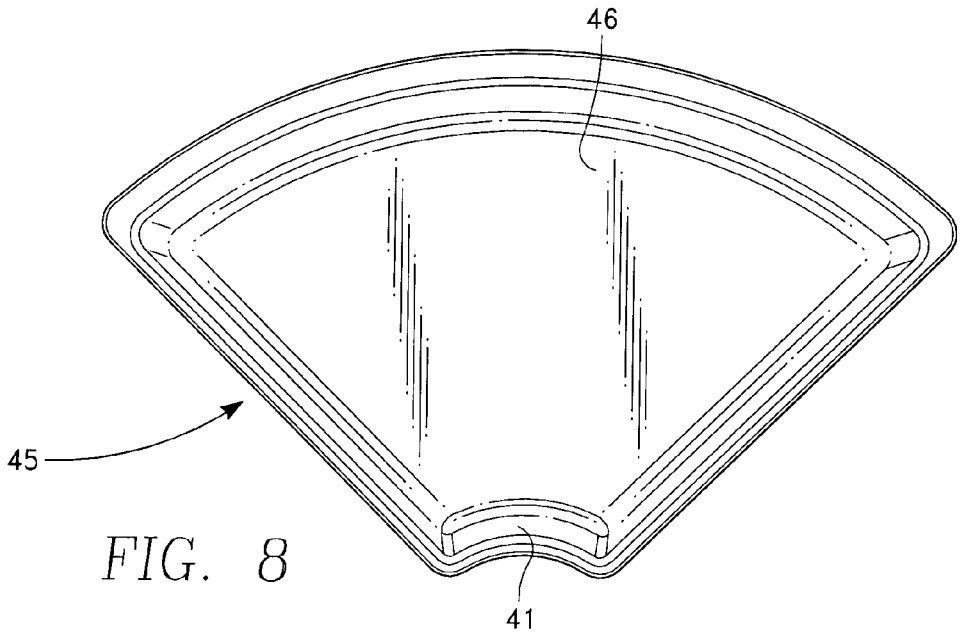
Figure 8A:
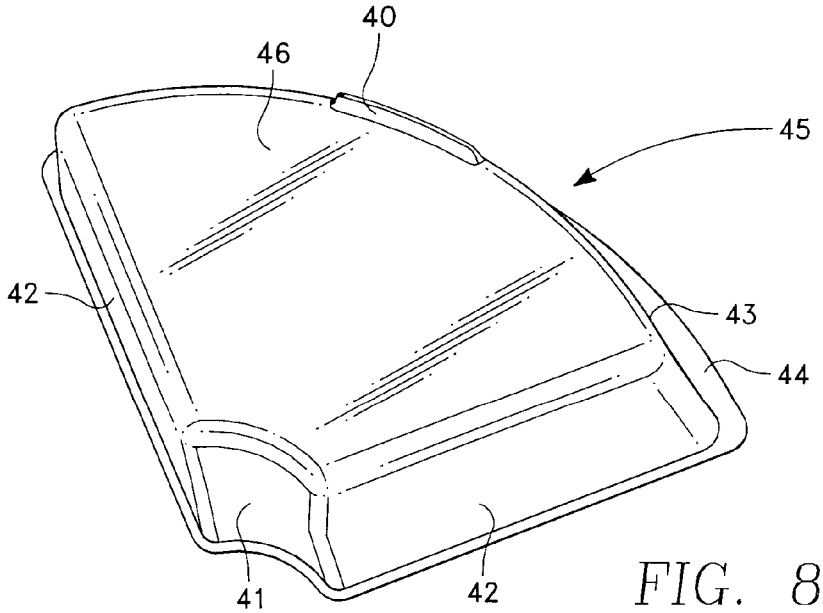
FIGS. 8*a*, 9*a* and 10*a* illustrate the same inserts, respectively, from a bottom view.
Figure 9:
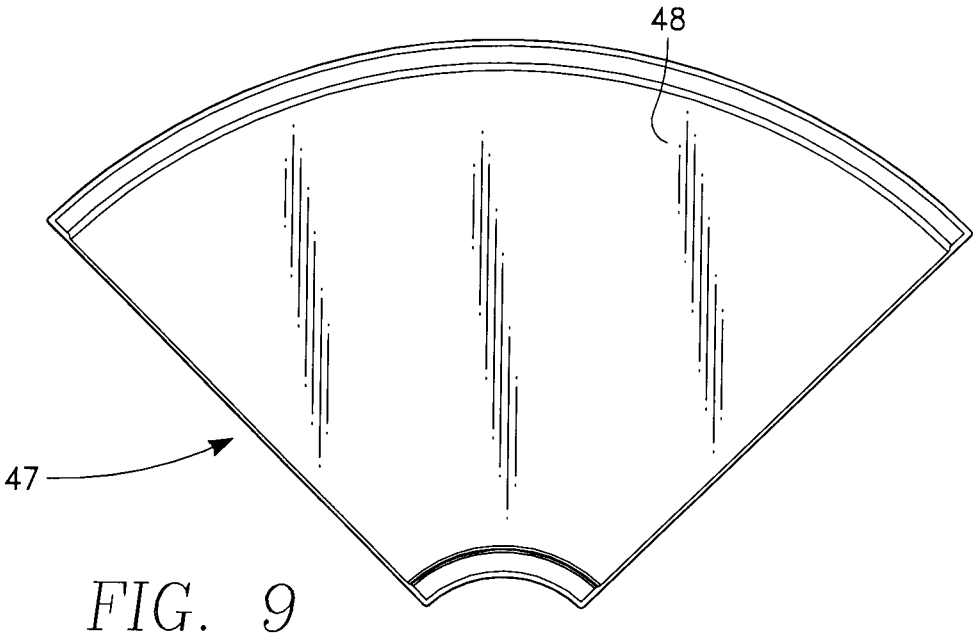
Figure 9A:
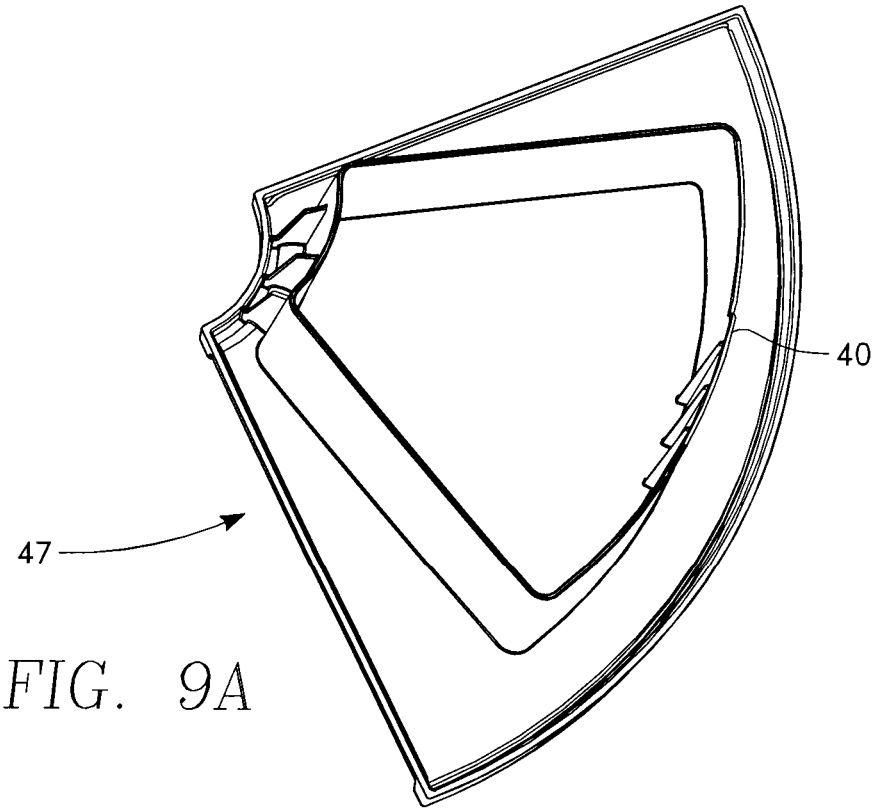
Figure 10:
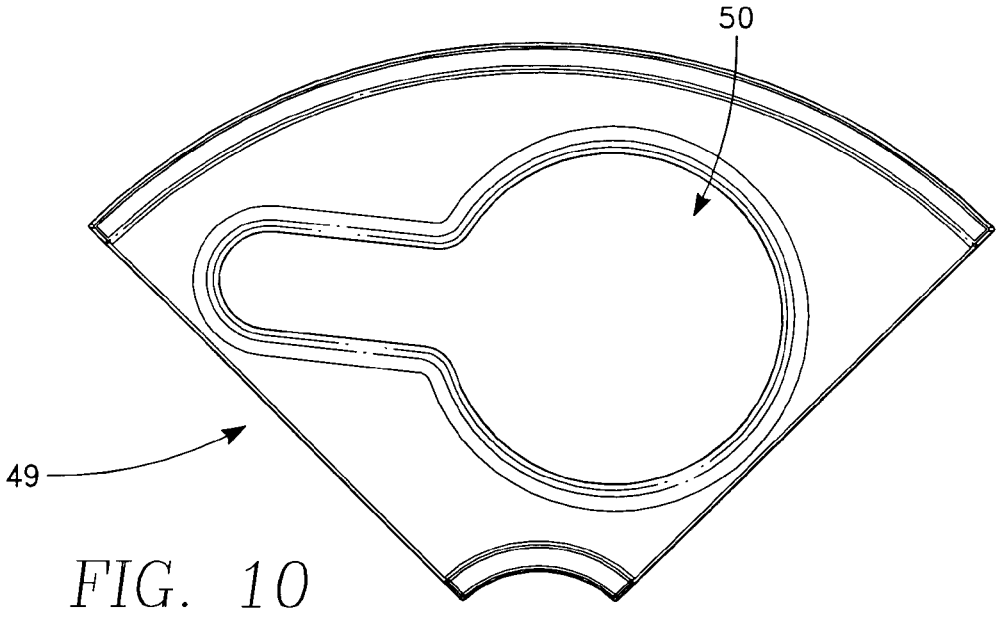
Figure 10A:
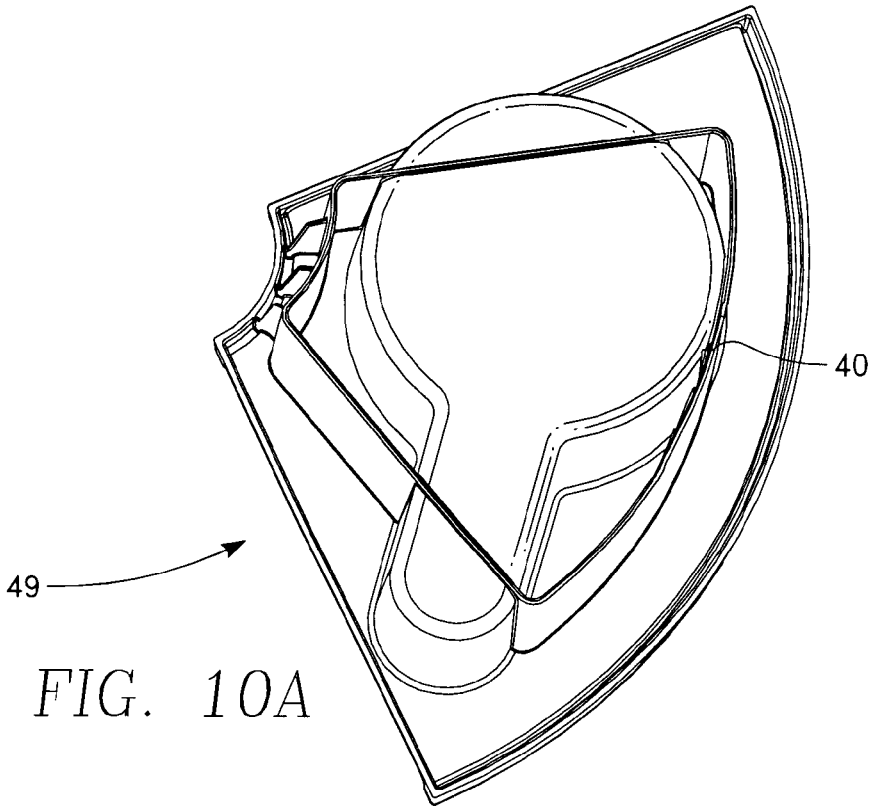

FIG. 7 illustrates use of a container insert 45, a shelf insert 47, and a cup holder insert 49. Each of these inserts has an insert tab 40 that is designed to be placed in one drain slot 23 to securely hold the insert in place inside of shelf 10. Note that while FIG. 7 illustrates use of three inserts, each different, any variation of inserts, from one to four, and of any variety of uses, can be chosen, and various inserts can be included in kits designed for use with a pole shelf according to the present invention. It is especially preferred that each insert be sized so that it takes up a quarter of the space of the upper surface 13 of the shelf bottom so that four inserts can easily be used in a mix and match fashion. Each insert will also have an inner radius that will contact a hub protrusion 14.

There are many distinct advantages obtainable by use of specially designed inserts for use with the pole shelf of the present invention. For example, a container insert 45 could be filled with food items, whether liquid, sauce or something else, and such items could be stored in the container insert inside of a refrigerator until the desired time of use, at which point the insert could be removed from the refrigerator and simply inserted into a pole shelf. Also, by having many such inserts, one can see that they could easily be replaced during social events.

While the invention has been described herein with reference to certain preferred embodiments, those embodiments have been presented by way of example only, and not to limit the scope of the invention. Thus, for example, shelf inserts could be built into the shelf itself. In addition, the pole shelf need not be circular, and can take a variety of shapes and sizes, and can be made non-symmetrical for certain applications such as where it is to be used in a corner or against another object. In addition, a Lazy Susan feature or integral lighting can be included in the pole shelf. Also, multiple pole shelves of different diameters or sizes can be attached to a single pole. Moreover, it might be possible to combine the features of a shelf and bracket, discussed above, in a single construction. Additional embodiments and further modifications are also possible in alternative embodiments that will be obvious to those skilled in the art having the benefit of this detailed description.

Accordingly, still further changes and modifications in the actual concepts described herein can readily be made without departing from the spirit and scope of the disclosed inventions as defined by the following claims.

What is claimed is:

1. A pole shelf for mounting on a pole, comprising:

a bracket comprised of a first and a second bracket piece, each of which is comprised of a bracket upper hub protrusion rib with a bracket upper hub inner wall;

a bracket lower hub protrusion rib with a bracket lower hub inner wall;

a lip extending substantially perpendicularly outwardly from, and located between, the upper and the lower hub protrusion ribs, said lip having an outer cam edge with a plurality of detents;

a pair of male mating sleeves;

a pair of female mating sleeves;

wherein each of the first and the second bracket pieces have two of the four of the pairs of male and female mating sleeves connected below an underside of the lip of said each of the first and the second bracket pieces, said pairs of male and female mating sleeves being capable of slidingly engaging with each other; and a pair of fasteners for locking the pair of male mating sleeves in the pair of female mating sleeves in a locked state in which the bracket upper and lower hub inner walls are held tightly against the pole so as to secure the bracket to the pole;

a shelf comprised of a first shelf piece and a second shelf piece, each of which is comprised of a shelf upper protrusion rib;

an outer wall;

a shelf bottom extending between the shelf upper protrusion rib and the outer wall, said shelf bottom having an upper shelf bottom surface and a lower shelf bottom surface;

a retention post connected to the lower shelf bottom surface;

a first connector for releasably connecting a first end of each of the first and the second shelf pieces to each other; and at least one shelf bottom connector for releasably connecting the shelf bottoms of the first and the second shelf pieces to each other;

wherein the bracket can be removably secured to a plurality of poles having a different outer diameter by adjusting the amount of sliding engagement existing between the pairs of male and female mating sleeves;

wherein the shelf is in a closed shelf state when the first connector and the at least one shelf bottom connector are each secured in a connected state; and wherein the shelf in the closed shelf state about the pole is secured to the bracket which is secured to the pole by engaging the retention post of the first and second shelf pieces with the outer cam edges of the first and second bracket pieces and rotating the shelf so that said outer cam edges become removably locked into said retention posts.

2. The pole shelf of claim 1, further comprising a second connector for releasably connecting a second end of each of the first and the second shelf pieces to each other.

3. The pole shelf of claim 1, wherein the shelf bottom has a plurality of drain holes.

4. The pole shelf of claim 3, further comprising at least one insert comprised of a tab for securing the at least one insert into one of the plurality of drain holes, an insert hub protrusion for mating against the shelf upper protrusion rib and an insert body.

5. The pole shelf of claim 4, wherein the at least one insert is comprised of four inserts that can be inserted into and secured in four drain holes in the shelf.

6. The pole shelf of claim 1, wherein the outer wall is comprised of an outer inner wall, a peripheral outer wall and an outer wall top surface connecting the outer inner wall to the peripheral outer wall.

7. The pole shelf of claim 1, wherein the pair of fasteners is integral with the pairs of male and female mating sleeves.

8. The pole shelf of claim 1, wherein the bracket upper and lower hub inner walls are further comprised of a notch so that the bracket can be secured to a pole having an angular edge.

9. The pole shelf of claim 1, wherein the at least one shelf bottom connector is comprised of a pair of overlapping tabs and a quick release connector.

10. A pole shelf for mounting on a pole, comprising:

a bracket comprised of a first and a second bracket piece, each of which is comprised of a bracket upper hub protrusion rib with a bracket upper hub inner wall;

a bracket lower hub protrusion rib with a bracket lower hub inner wall;

a lip extending substantially perpendicularly outwardly from, and located between, the upper and the lower hub protrusion ribs, said lip having an outer cam edge with a plurality of detents; and a releasable fastener locking the first and the second bracket pieces in a locked state in which the bracket upper and lower hub inner walls are held tightly against the pole so as to secure the bracket to the pole;

a shelf comprised of a first shelf piece and a second shelf piece, each of which is comprised of a shelf upper protrusion rib;

an outer wall;

a shelf bottom extending between the shelf upper protrusion rib and the outer wall, said shelf bottom having an upper shelf bottom surface and a lower shelf bottom surface;

a retention post connected to the lower shelf bottom surface;

a first connector for releasably connecting a first end of each of the first and the second shelf pieces to each other; and a plurality of shelf bottom connectors for releasably connecting the shelf bottoms of the first and the second tray pieces to each other;

wherein the bracket can be removably secured to a plurality of poles having a different outer diameter by adjusting the releasable fastener;

wherein the shelf is in a closed shelf state when the first connector and the plurality of shelf bottom connectors are each secured in a connected state; and wherein the shelf in the closed shelf state about the pole is secured to the bracket which is secured to the pole by engaging the retention post of the first and second shelf pieces with the outer cam edges of the first and second bracket pieces and rotating the shelf so that said outer cam edges become removably locked into said retention posts.

* * * * *